US009566716B2

(12) United States Patent
Smith et al.

(10) Patent No.: US 9,566,716 B2
(45) Date of Patent: Feb. 14, 2017

(54) CUTTING ASSEMBLIES FOR USE IN CUTTING TUBING

(71) Applicant: Blazing Products, Inc., Chesterfield, MO (US)

(72) Inventors: Duane K. Smith, St. Charles, MO (US); Douglas L. Kirk, Ballwin, MO (US); Aaron Boaz, St. Louis, MO (US)

(73) Assignee: BLAZING PRODUCTS, INC., Chesterfield, MO (US)

( * ) Notice: Subject to any disclaimer, the term of this patent is extended or adjusted under 35 U.S.C. 154(b) by 16 days.

(21) Appl. No.: 13/667,232

(22) Filed: Nov. 2, 2012

(65) Prior Publication Data

US 2013/0118015 A1 May 16, 2013

Related U.S. Application Data

(60) Provisional application No. 61/555,343, filed on Nov. 3, 2011.

(51) Int. Cl.
*B26B 13/00* (2006.01)
*B26B 17/00* (2006.01)
*B26D 3/16* (2006.01)

(52) U.S. Cl.
CPC ..... *B26B 17/00* (2013.01); *B26D 3/169* (2013.01)

(58) Field of Classification Search
CPC ..... B26D 3/169; B26B 17/00
USPC ..... 30/260, 94–96, 258, 261, 92, 230, 231, 30/159, 338, 229
See application file for complete search history.

(56) References Cited

U.S. PATENT DOCUMENTS

| | | | | |
|---|---|---|---|---|
| 601,506 | A | | 3/1898 | Eames |
| 1,344,629 | A | | 6/1920 | Fowler |
| 1,885,895 | A | | 11/1932 | Carey |
| 1,988,847 | A | | 1/1935 | Kiefner |
| 2,939,213 | A | * | 6/1960 | Daniel ..... 30/260 |
| D201,832 | S | | 8/1965 | Fuller |
| 3,422,532 | A | | 1/1969 | Ballard |
| 3,949,474 | A | * | 4/1976 | Sandbrook et al. ..... 30/260 |
| 4,193,189 | A | * | 3/1980 | Marin ..... 30/260 |
| 4,269,089 | A | | 5/1981 | Hastings |
| 4,296,655 | A | | 10/1981 | Tesoro |
| 4,336,652 | A | | 6/1982 | Robertson |
| D266,736 | S | | 11/1982 | Robertson |
| 4,429,460 | A | | 2/1984 | Hill et al. |
| 4,438,669 | A | | 3/1984 | Hastings et al. |
| 4,581,960 | A | | 4/1986 | Putsch et al. |
| 4,612,708 | A | * | 9/1986 | Hattori ..... 30/260 |
| 4,773,288 | A | | 9/1988 | Jang et al. |
| 4,890,388 | A | * | 1/1990 | Rose ..... 30/260 |
| 5,461,951 | A | | 10/1995 | Putsch |

(Continued)

*Primary Examiner* — Omar Flores Sanchez
(74) *Attorney, Agent, or Firm* — Harness, Dickey & Pierce, P.L.C.

(57) ABSTRACT

A cutting assembly for cutting tubing generally includes first and second arms pivotally coupled together such that the first arm can pivot relative to the second arm, and a blade releasably coupled to the first arm and/or the second arm and oriented such that a longitudinal axis of the blade is generally parallel to a longitudinal axis of the first arm. The blade is removable from the first arm and/or the second arm by sliding the blade longitudinally in a direction along the longitudinal axis of the first arm. A release mechanism operates to selectively allow the blade to be removed from the first arm and/or the second arm.

12 Claims, 9 Drawing Sheets

(56) References Cited

U.S. PATENT DOCUMENTS

| | | | | |
|---|---|---|---|---|
| 5,621,974 | A * | 4/1997 | Rose et al. | 30/260 |
| 5,676,029 | A | 10/1997 | Putsch | |
| 5,845,551 | A | 12/1998 | Putsch | |
| 5,904,078 | A | 5/1999 | Gustafson et al. | |
| D412,095 | S | 7/1999 | Tally | |
| 6,357,120 | B1 * | 3/2002 | Khachatoorian | B26B 5/001 30/162 |
| 6,370,780 | B1 | 4/2002 | Robertson et al. | |
| 6,658,738 | B1 | 12/2003 | King | |
| 7,080,455 | B1 * | 7/2006 | Ronan et al. | 30/122 |
| 7,204,021 | B2 | 4/2007 | Houseman et al. | |
| 7,346,986 | B2 | 3/2008 | Feith | |
| D588,427 | S | 3/2009 | Manak | |
| 7,549,226 | B2 | 6/2009 | Mortensen | |
| 7,637,017 | B2 * | 12/2009 | Retterer et al. | 30/241 |
| D612,221 | S | 3/2010 | Groten et al. | |
| D612,697 | S | 3/2010 | Huang | |
| 8,024,864 | B2 | 9/2011 | Mortensen | |
| 8,113,096 | B2 * | 2/2012 | Retterer et al. | 83/13 |
| 8,327,548 | B2 * | 12/2012 | Ronan | B26B 17/00 30/175 |
| D679,564 | S | 4/2013 | Hong | |
| 8,621,754 | B2 * | 1/2014 | Adachi | 30/194 |
| 2011/0214292 | A1 * | 9/2011 | Heh | 30/228 |
| 2013/0118015 | A1 | 5/2013 | Smith et al. | |

* cited by examiner

CUTTING ASSEMBLIES FOR USE IN CUTTING TUBING

CROSS-REFERENCE TO RELATED APPLICATION

This application claims the benefit of U.S. Provisional Application No. 61/555,343, filed Nov. 3, 2011, and titled Cutting Assemblies for Use in Cutting Tubing. The entire disclosure of the above application is incorporated herein by reference.

FIELD

The present disclosure generally relates to cutting assemblies and, more particularly, to cutting assemblies that can be used, for example, in cutting tubing, etc., and to methods of using such cutting assemblies.

BACKGROUND

This section provides background information related to the present disclosure which is not necessarily prior art.

Pipe cutters are often used to cut pipes in connection with irrigation and water line installation. Such cutters typically have a pair of pivotal arms and a blade disposed at the end of one of the arms to effect the cutting operation.

SUMMARY

This section provides a general summary of the disclosure, and is not a comprehensive disclosure of its full scope or all of its features.

Example embodiments of the present disclosure are generally directed toward cutting assemblies configured, for example, to cut tubing. In one example embodiment, a cutting assembly generally includes first and second arms pivotally coupled together such that the first arm can pivot relative to the second arm, and a blade releasably coupled to the first arm and/or the second arm and oriented such that a longitudinal axis of the blade is generally parallel to a longitudinal axis of the first arm. The blade is removable from the first arm and/or the second arm by sliding the blade longitudinally in a direction along the longitudinal axis of the first arm.

In another example embodiment, a cutting assembly generally includes first and second arms pivotally coupled together such that the first arm can pivot relative to the second arm, a blade releasably coupled to the first arm and/or the second arm and oriented such that a longitudinal axis of the blade is generally parallel to a longitudinal axis of the first arm, and a mounting unit configured to support the blade in the cutting assembly and inhibit rotational movement of the blade relative to the first and second arms.

In another example embodiment, a cutting assembly generally includes first and second arms pivotally coupled together such that the first arm can pivot relative to the second arm, a blade releasably coupled to the first arm and/or the second arm and oriented such that a longitudinal axis of the blade is generally parallel to a longitudinal axis of the first arm, and a release mechanism moveable between a first position in which the release mechanism couples the blade to the first arm and/or the second arm and a second position in which the release mechanisms allows the blade to be removed from the first arm and the second arm. The release mechanism includes a resilient member configured to bias the release mechanism from the second position toward the first position.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
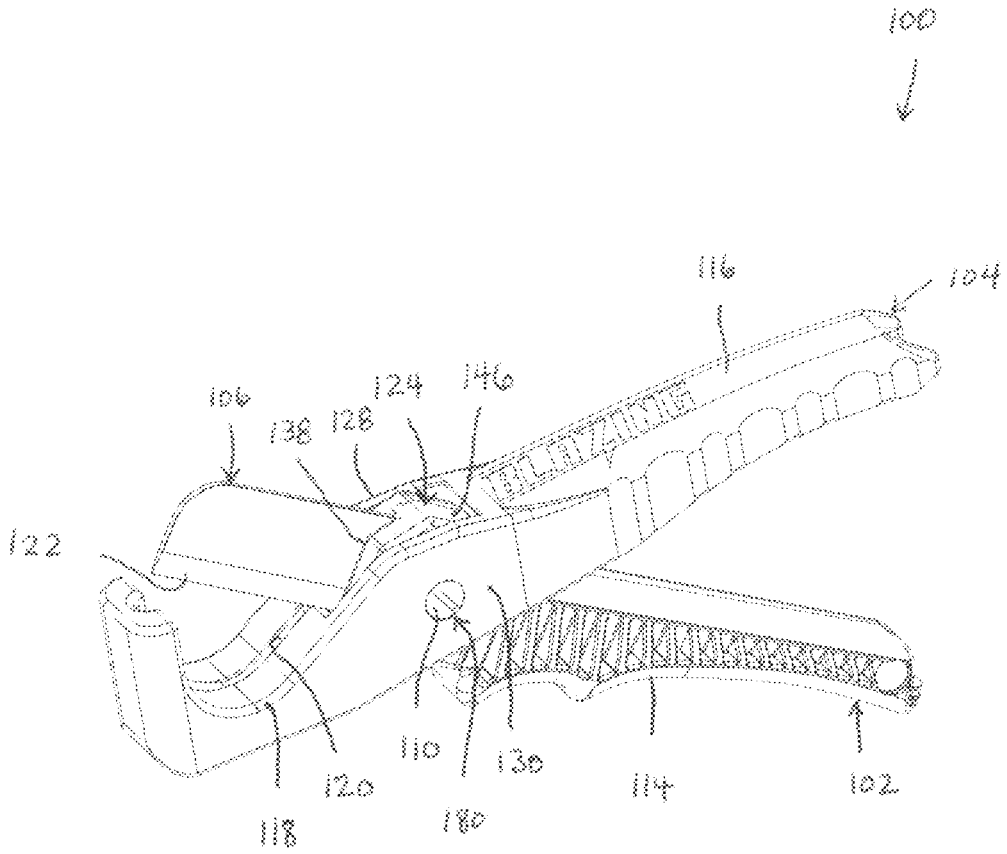
FIG. 1 is an upper perspective view of a cutting assembly according to one example embodiment of the present disclosure and shown in an open position.

The present disclosure generally relates to cutting assemblies (and methods related thereto) that can be used to cut tubes, pipes, extrusions, etc. (broadly, tubing) often used, for example, in irrigation systems, water systems, etc. The cutting assemblies can cut tubing constructed from, for example, plastic, rubber, combinations thereof, or other suitable materials within the scope of the present disclosure. And, the cutting assemblies can be configured (e.g., sized, shaped, constructed, etc.) to cut desired sizes (e.g., diameters, etc.), thicknesses, shapes, etc. of such tubing.

In one aspect, the cutting assemblies include removable, replaceable, etc. blades. The blades are configured to be inserted and/or removed from the cutting assemblies by sliding the blades into and/or out of the cutting assemblies. For example, the cutting assemblies may include arms pivotally coupled together for operation to cut tubing. The blades are releasably coupled to the arms (e.g., to one of the arms of the cutting assemblies, etc.) and oriented such that longitudinal axes of the blades are generally parallel to longitudinal axes of one of the arms of the cutting assemblies. The blades are removable from the cutting assemblies by sliding the blades in a direction extending generally along the longitudinal axes of the said one of the arms.

In another aspect, the cutting assemblies include release mechanisms that are operable (e.g., manually, automatically, etc.) to selectively retain the blades in the cutting assemblies (e.g., for use during cutting operations, etc.) and release the blades from the cutting assemblies (e.g., to allow the blades to be removed from the cutting assemblies, to allow different blades to be inserted into the cutting assemblies, etc.). In some instances, the release mechanisms are predisposed (e.g., automatically, etc.) to retain the blades in the cutting assemblies so that, when the blades are positioned in the cutting assemblies, the cutting assemblies are automatically ready for use. When desired, users can manipulate the release mechanisms to release the blades and insert different blades into the cutting assemblies and, upon completion, the release mechanisms will again predispose to retain the different blades in the cutting assemblies. The release mechanisms may be predisposed to retain the blades in the cutting assemblies by suitable means including, for example, resilient members (e.g., springs, coil springs, rubber members, etc.), pistons, spring latches, other suitable devices, etc.

In another aspect, the cutting assemblies include mounting units configured to support the blades in the cutting assemblies (and/or help align the blades, retain the blades, protect the blades (e.g., against bending, against undesired movement during use, etc.), etc. in the cutting assemblies). In accordance with this aspect, the mounting units may include separate structures (e.g., frames, inserts, etc.) coupled to the cutting assemblies. Or, the mounting units may be integrally formed and coupled to other components (e.g., arms, etc.) of the cutting assemblies. Or further, the mounting units may be integrally formed directly with the other components (e.g., the arms, etc.) of the cutting assemblies.

It should be appreciated that the cutting assemblies of the present disclosure can include one or more of the above described aspects in any desired combination, and can further include any of the other features described herein as desired. With that said, example embodiments of the cutting assemblies will now be described more fully with reference to the accompanying drawings.

Figure 2:
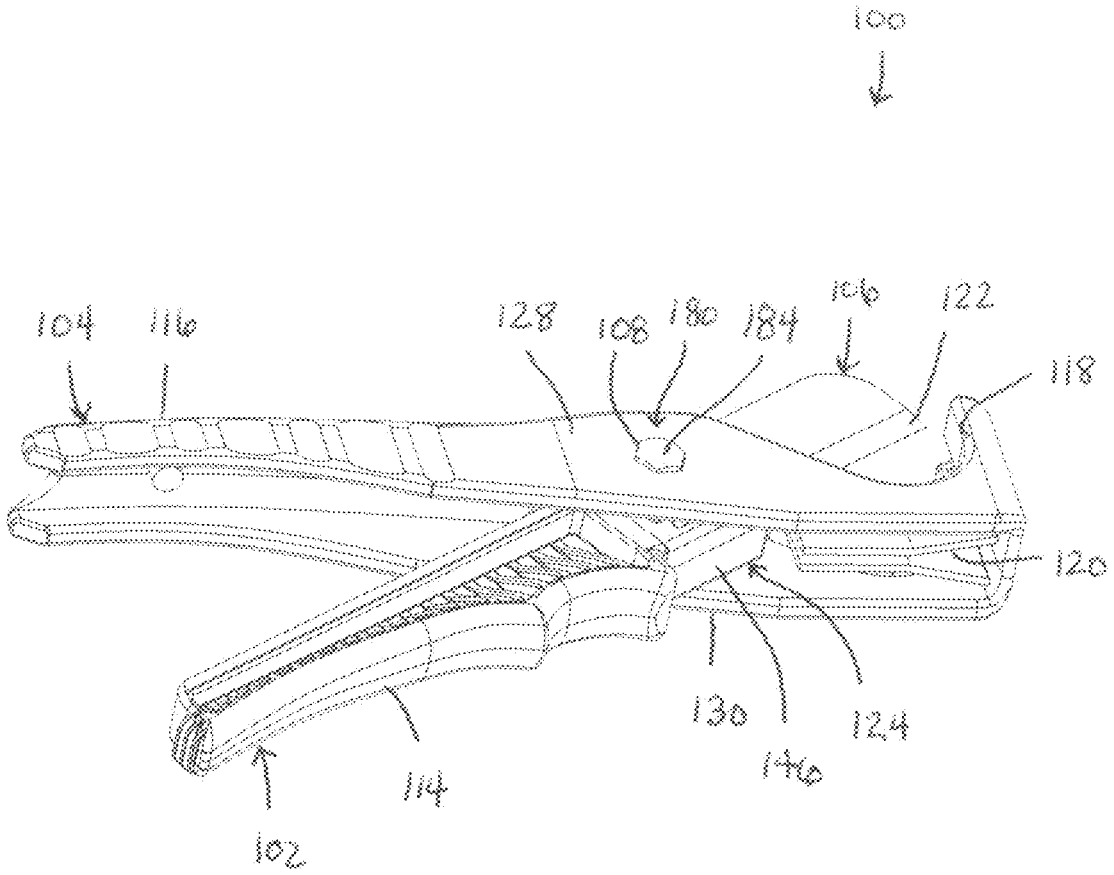
FIG. 2 is a lower perspective view of the cutting assembly of FIG. 1.
Figure 3:
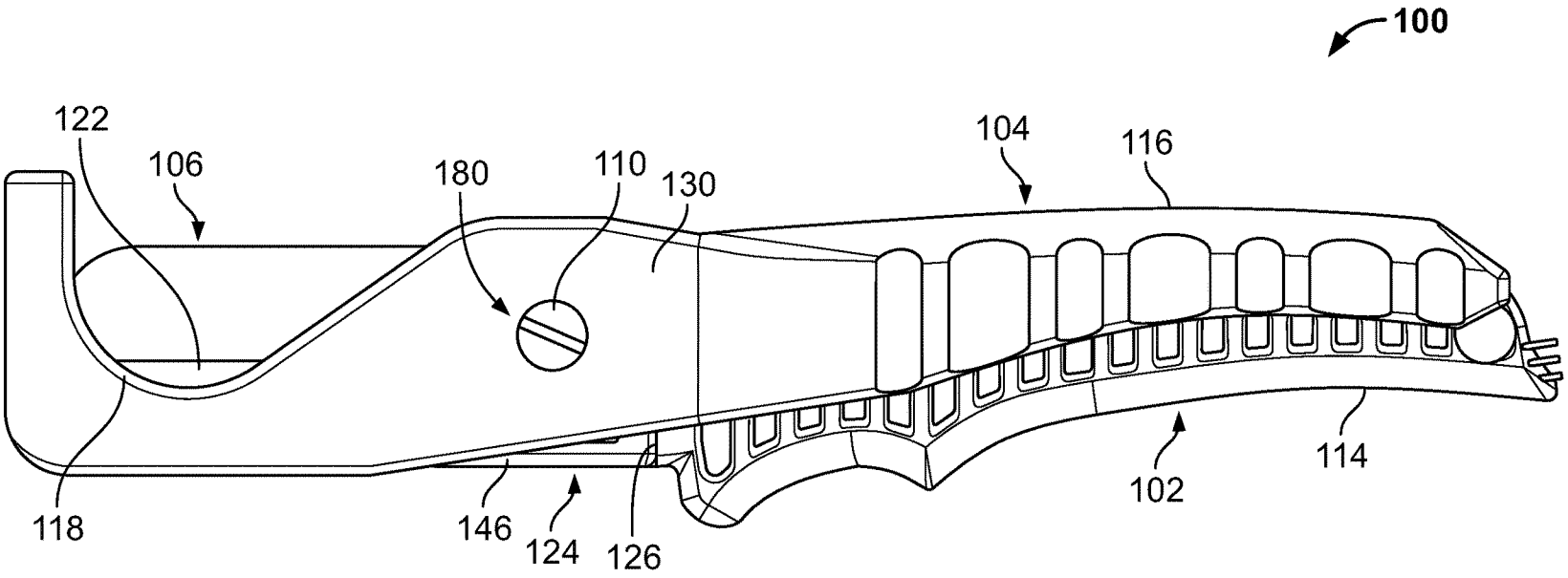
FIG. 3 is a perspective view of the cutting assembly of FIG. 1, with the cutting assembly shown in a closed position.
Figure 4:
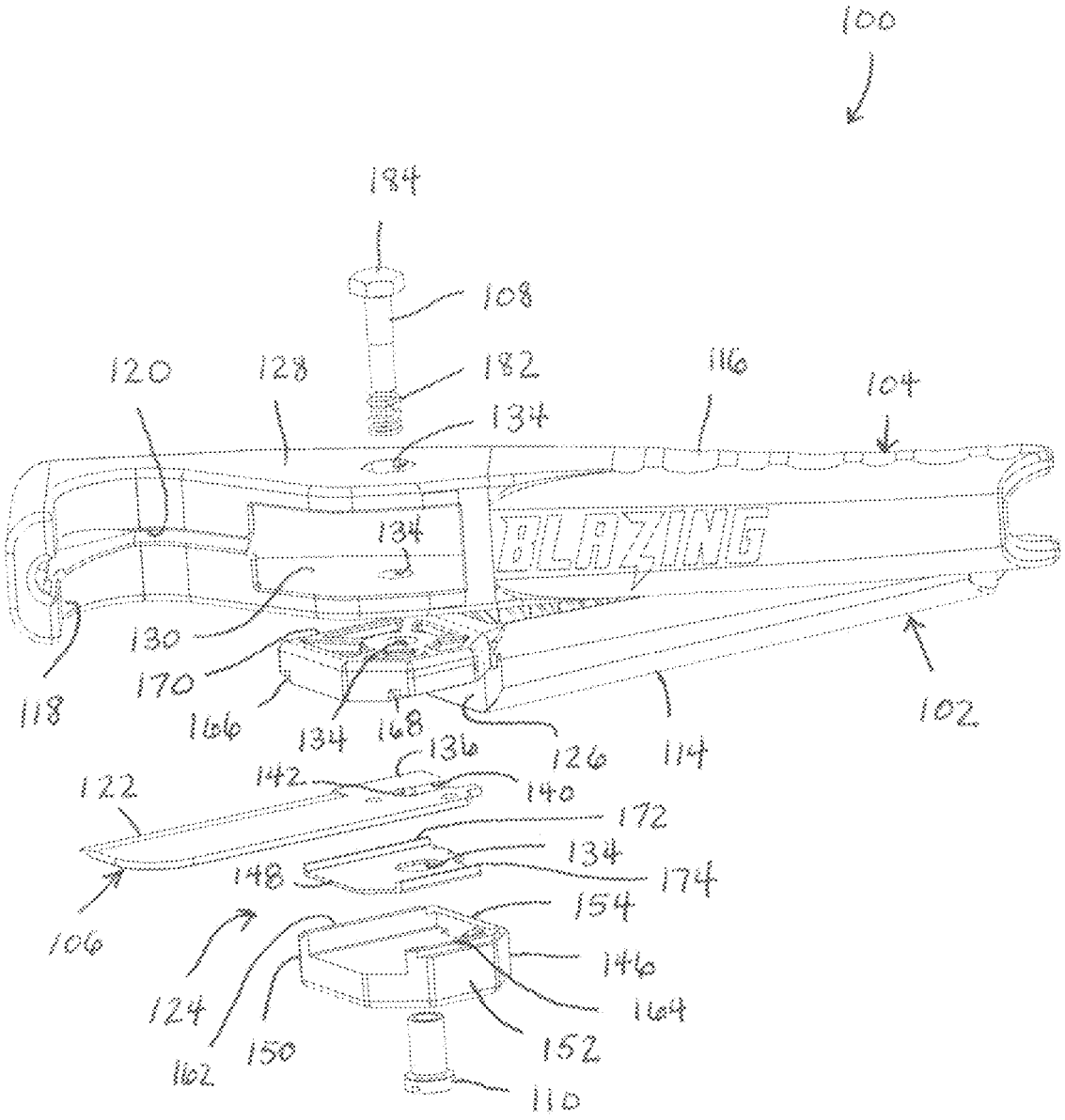
FIG. 4 is an exploded, upper perspective view of the cutting assembly of FIG. 1.
Figure 5:
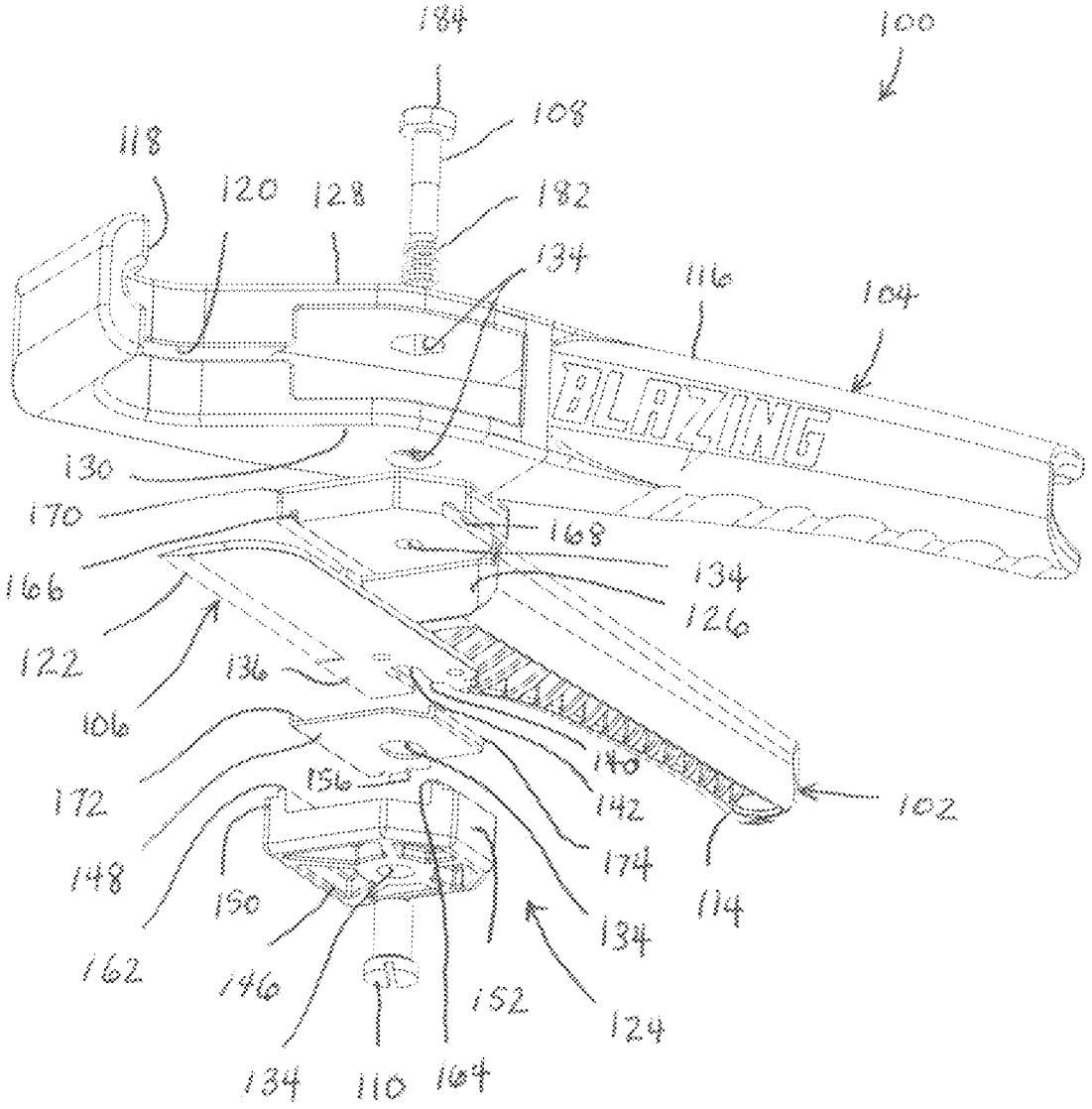
FIG. 5 is an exploded, lower perspective view of the cutting assembly of FIG. 1.
Figure 6:
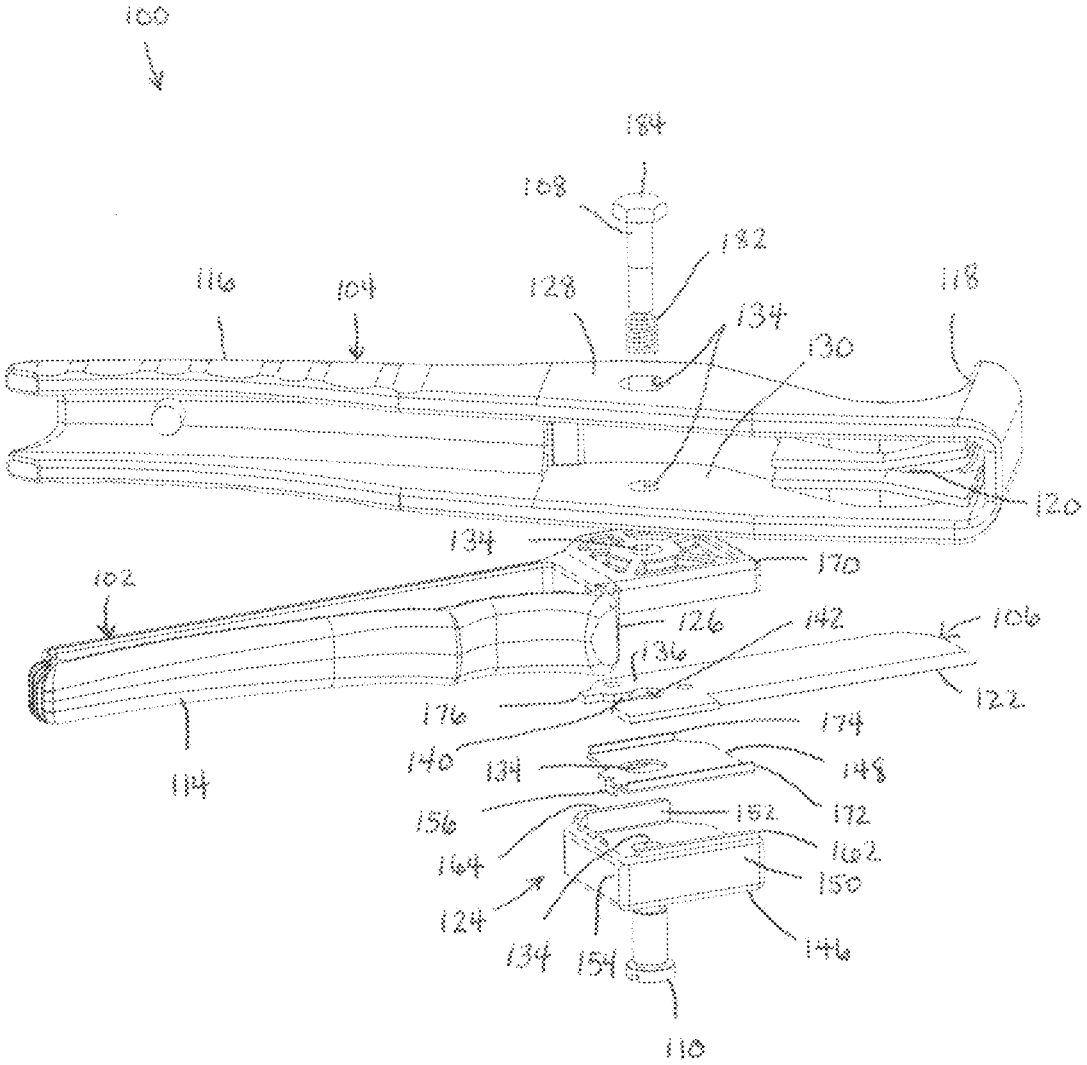
FIG. 6 is another exploded, upper perspective view of the cutting assembly of FIG. 1.
Figure 7:
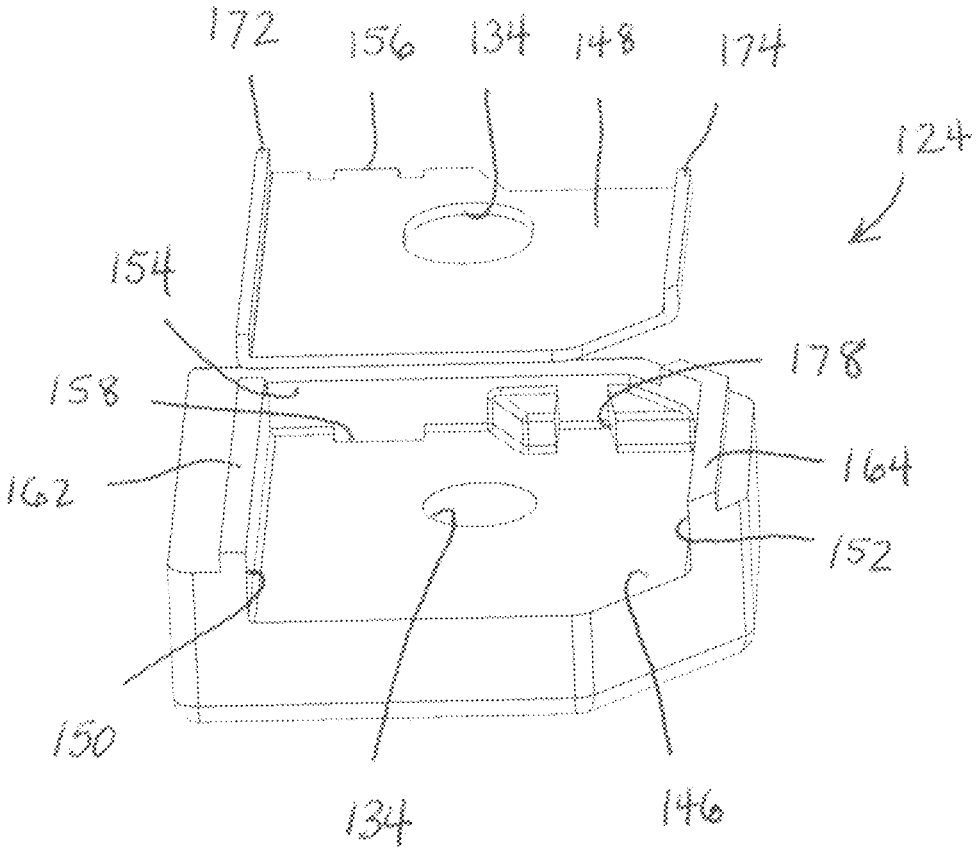
FIG. 7 is an exploded perspective view of a mounting unit of the cutting assembly of FIG. 1.
Figure 8:
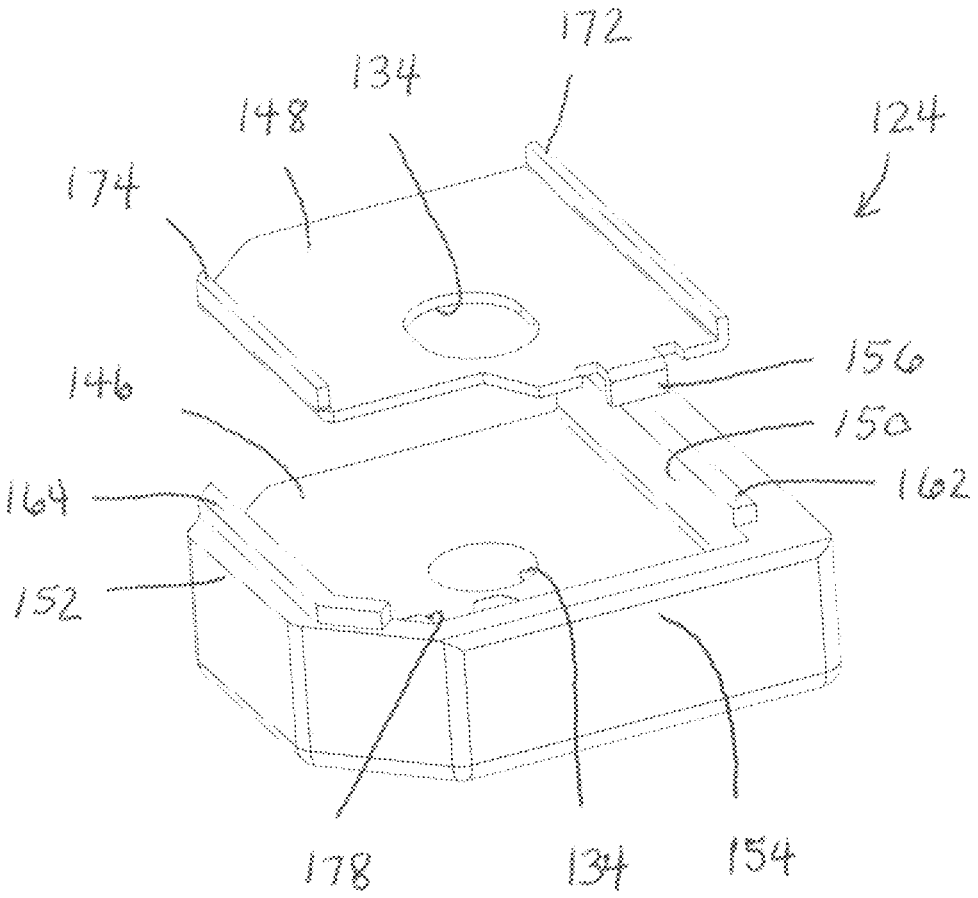
FIG. 8 is another exploded perspective view of the mounting unit of FIG. 7.
Figure 9:
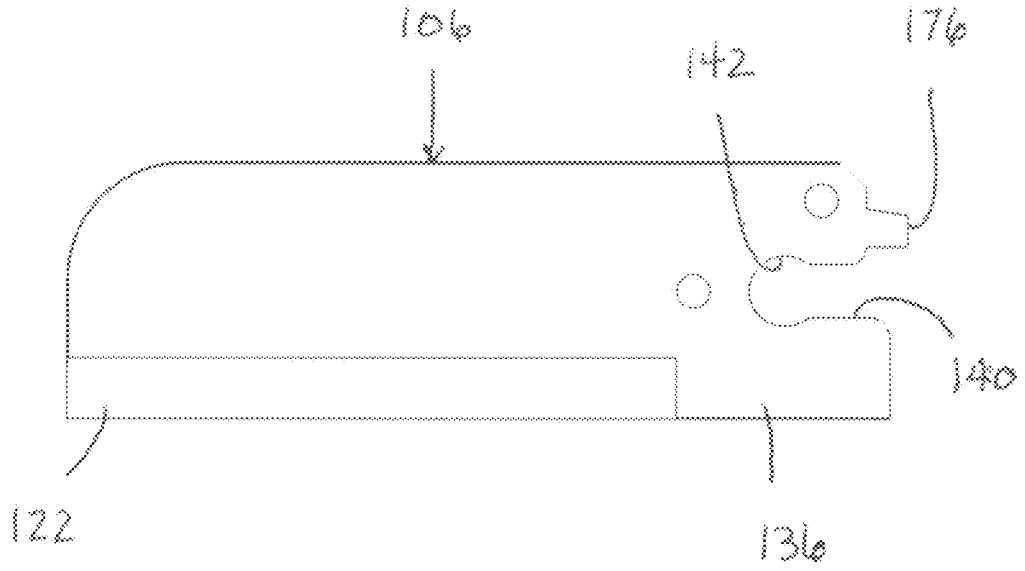
FIG. 9 is a side elevation view of a blade of the cutting assembly of FIG. 1.

FIGS. 1-9 illustrate an example embodiment of a cutting assembly 100 of the present disclosure. As shown in FIGS. 1-3, the illustrated cutting assembly 100 generally includes two arms 102, 104 and a blade 106 releasably coupled to the arms 102, 104 for cutting desired tubing. The arms 102, 104 are pivotally coupled together by a threaded fastener 108 and a corresponding sleeve 110 (broadly, a hinge assembly) (FIGS. 4-6). As such, the cutting assembly 100 is selectively pivotal between an open position where the arms 102, 104 and blade 106 are generally apart (FIGS. 1 and 2) and a closed position where the arms 102, 104 and blade 106 are generally nested together (FIG. 3). In the open position the cutting assembly 100 can receive the tubing to be cut (e.g., between the blade 106 and the arm 102, etc.). The cutting assembly 100 can then be moved to the closed position thereby moving the blade 106 to cut the tubing. While not illustrated, the arms 102, 104 may include one or more latches, etc. for holding the arms 102, 104 and blade 106 together in the closed position, for example, when storing the cutting assembly 100, etc.

The arms 102, 104 of the illustrated cutting assembly 100 include respective handle portions 114, 116 contoured to allow a user to grasp the arms 102, 104 during use and, for example, move the cutting assembly 100 between the open and closed positions. As such, the handle portions 114, 116 can help facilitate grasping both arms 102, 104 of the cutting assembly 100 with one hand during cutting operation. However, the handle portions 114, 116 also provide a unique ornamental look to the cutting assembly 100 that can help distinguish it from other cutting assemblies. With that said, the handle portions 114, 116 could be shaped differently within the scope of the present disclosure (see, e.g., U.S. Pat. No. 6,658,738, which is incorporated herein by reference in its entirety; etc.).

With continued reference to FIGS. 1-3, the handle portion 116 of the arm 104 is generally channel shaped to allow the handle portion 114 of the arm 102 to nest therein when the cutting assembly 100 is in the closed position. In addition, the arm 104 also includes a cradle portion 118 located generally opposite the handle portion 116 and toward an end of the arm 104. The illustrated cradle portion 118 has a generally arcuate shape to help accommodate the tubing to be cut by the cutting assembly 100. And, a forward part of the cradle portion 118 is generally hooked to help confine the tubing within the cutting assembly 100 during the cutting (e.g., in a position to be cut by the blade 106, etc.). In addition, a slot 120 is defined generally longitudinally along the cradle portion 118 to receive the blade 106 when the cutting assembly 100 moves to the closed position. The slot 120 is configured to allow the blade 106 to pass completely through the tubing during the cutting operation to allow complete severance of the tubing. The slot 120 also provides a location to store, protect, etc. the blade 106 (e.g., a sharpened cutting portion 122 of the blade 106, etc.) when the cutting assembly 100 is in the closed position.

With additional reference now to FIGS. 4-8, the cutting assembly 100 also includes a mounting unit 124 to support the blade 106 in the cutting assembly 100 and help inhibit rotational movement of the blade 106 relative to the arms 102, 104 during cutting operation. In particular, the mounting unit 124 operates to help align, support, retain, protect, etc. the blade 106 in the cutting assembly 100, for example, during use to cut tubing. The mounting unit 124 is positioned on a plateau 126 of the arm 102 and is received between side wall portions 128, 130 of the arm 104 when the arms 102, 104 are assembled. The mounting unit 124 is coupled to the arms 102, 104 by the fastener 108 and the sleeve 110 positioned through aligned openings (each indicated at reference number 134) of the arms 102, 104 and the mounting unit 124. And, the blade 106 is positioned in the mounting unit 124 with an end portion 136 of the blade 106 disposed in a receptacle 138 (FIG. 1) defined by the mounting unit 124, with the sharpened cutting portion 122 of the blade 106 extending out of the mounting unit 124 for use. As such, a longitudinal axis of the blade 106 is generally parallel to a longitudinal axis of the arm 102. A channel 140 and a corresponding opening 142 are defined in the end portion 136 of the blade 106 to allow the blade 106 to fit over the fastener 108 and the sleeve 110 in the receptacle 138 of the mounting unit 124. As such, in cutting operation, the blade 106 generally pivots along with the arms 102, 104 about the fastener 108 and the sleeve 110.

The illustrated mounting unit 124 generally includes a frame 146 and an insert 148 configured to help align, support, retain, protect, etc. the blade 106 in the cutting assembly 100. The insert 148 is configured to fit within the frame 146. The frame 146 includes two opposing side walls 150, 152 and a bottom wall 154 that define a channel in the frame 146 for receiving the insert 148. A tab 156 of the insert 148 is received in a recessed opening 158 (FIG. 7) of the frame 146 to help align and retain the insert 148 therein. End portions 162, 164 of the frame's side walls 150, 152 are keyed and configured to fit within corresponding channels 166, 168 defined in a side wall 170 of the arm 102 to help align and position the frame 146 (and insert 148) on the arm's plateau 126. The insert 148 includes two opposing side walls 172, 174 configured to receive the end portion 136 of the blade 106 there between. The side walls 172, 174 are spaced apart a distance about equal to a width dimension of the end portion 136 of the blade 106. As such, the blade 106 securely fits in the insert 148 between the side walls 172, 174. And, a tab 176 of the end portion 136 of the blade 106 fits within a notch opening 178 (FIGS. 7 and 8) in the bottom wall 154 of the frame 146 to help further align and retain the blade 106 in the insert 148 (between the side walls 172, 174) and in the frame 146.

In the illustrated embodiment, the frame 146 is die cast from aluminum and the insert 148 is formed from steel. As such, the frame 146 provides support to the insert 148 and the blade 106 against, for example, sharp impacts (e.g., drops, etc.), stresses, etc. And, the insert 148, via its sidewalls 172, 174, provides resistance to repeated movement of the blade 106 during cutting operation (e.g., prying and rotating stresses imparted on the blade 106 during the cutting operation, etc.). It should be appreciated, however, that the frame 146 and insert 148 may be constructed from other suitable materials within the scope of the present disclosure (e.g., steel, aluminum, combinations thereof, alloys thereof, other suitable materials, etc.). In addition, in other example embodiments, mounting units may include single structures such as, for example, frames and inserts formed together as single, unitary components and coupled to arms of cutting assemblies. In still other example embodiments, mounting units may be formed as integral, unitary structures directly with other components of cutting assemblies (e.g., arms, etc.).

With continued reference to FIGS. 4-8, the illustrated cutting assembly 100 further includes a release mechanism 180 (e.g., a quick-release mechanism, etc.) operable to selectively couple the blade 106 to the arms 102, 104 and release the blade 106 from the arms 102, 104 as desired. The release mechanism 180 is operable between a locking position in which it holds the blade 106 in the cutting assembly 100 and a releasing position in which it allows the blade 106 to be removed from the cutting assembly 100 (or allows a different blade to be inserted into the cutting assembly 100). For example, in the locking position, the release mechanism 180 resists, inhibits, etc. movement of the blade 106 out of the cutting assembly 100 and readies the cutting assembly 100 (and the blade 106) for cutting operation. In the releasing position, the release mechanism 180 allows the blade 106 to be slid out of the mounting unit 124 (longitudinally in a direction along the longitudinal axis of the arm 102) and allows a different blade to be slid into the mounting unit 124 as desired.

The illustrated release mechanism 180 is automatically disposed toward the locking position. This feature operates to automatically secure the blade 106 in the cutting assembly 100, ready for use. When desired to remove the blade 106 from the cutting assembly 100 and insert 148 a different blade into the cutting assembly 100, the release mechanism 180 can be operated (e.g., manually, automatically, etc.) from the locking position to the releasing position (an example of such an operation will be described in more detail hereinafter). Upon completion of such operation (e.g., after the blade 106 is removed and a different blade is inserted, etc.), the release mechanism 180 automatically transitions back to the locking position such that the cutting assembly 100 is ready for use (with the different blade installed).

In the illustrated embodiment, the fastener 108 and sleeve 110 form part of the release mechanism 180 (where the fastener 108 is configured to thread partially into the sleeve 110). In addition, the release mechanism 180 includes a spring 182 (broadly, a resilient member) positioned between an outer portion of the side wall 170 of the arm 102 and a head portion 184 of the fastener 108 (e.g., to automatically transition the release mechanism 180 from the releasing position to the locking position, etc.). The side wall 170 of the arm 102 is thus positioned generally between the spring 182 and the sleeve 110. The fastener 108 and the sleeve 110 are sized to allow sliding movement of the fastener 108 and sleeve 110 in a longitudinal direction relative to the arms 102, 104, the blade 106, the frame 146, and the insert 148 (generally within the openings 134). However, the spring 182 is configured to resist such movement and hold the fastener 108 and sleeve 110 generally tight in the cutting assembly 100 (under normal operation). When the release mechanism 180 is in the locking position, the spring 182 automatically urges the head portion 184 of the fastener 108 away from the side wall 170 of the arm 102 which pulls the sleeve 110 into the opening 142 of the blade 106. The channel 140 of the blade 106 has a width dimension that is smaller than a diameter of the sleeve 110 (and smaller than a diameter of the opening 142). As such, the sleeve 110 cannot fit into the channel 140 of the blade 106 and thus operates to hold, retain, etc. the blade 106 in the mounting unit 124 on the cutting assembly 100. To release the blade 106 from the cutting assembly 100, the head portion 184 of the fastener 108 is pushed toward the side wall 170 of the arm 102, against the resistance of the spring 182 (thereby compressing the spring 182). This pushes the sleeve 110 out of the opening 142 of the blade 106 and moves the fastener 108 (which is smaller in diameter than the sleeve 110) into the opening 142 (this also may push a portion of the sleeve 110 out of the opening 134 of the arm 104). The diameter of the fastener 108 is smaller than the width dimension of the channel 140 of the blade 106 such that, in this releasing position, the blade 106 can now be removed from the cutting assembly 100 by sliding the blade 106 out of the mounting unit 124 longitudinally in a direction along the longitudinal axis of the arm 102 (with the fastener 108 sliding through the channel 140 of the blade 106). With the release mechanism 180 held in the releasing position, a different blade can then similarly be inserted into the mounting unit 124 of the cutting assembly 100 as desired. Once the different blade is inserted, the head portion 184 of the fastener 108 is released and the spring 182 automatically moves the fastener 108 out of the blade's opening 142 and pulls the sleeve 110 back there in (automatically moving the release mechanism 180 back to the locking position).

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A cutting assembly configured to cut tubing, the cutting assembly comprising:

first and second arms pivotally coupled together such that the first arm can pivot relative to the second arm;

a blade releasably coupled to the first arm and oriented such that a longitudinal axis of the blade is generally parallel to a longitudinal axis of the first arm;

a mounting unit configured to support the blade in the cutting assembly and inhibit rotational movement of the blade relative to the first and second arms; and a release mechanism coupling the mounting unit to the first arm, and operable to selectively couple the blade to the first arm so that the blade is selectively removable from the first arm without decoupling the first arm and the second arm, the release mechanism defining a hinge assembly about which the first and second arms pivot;

wherein the release mechanism is moveable between a first position in which the release mechanism couples the blade to the first arm and a second position in which the release mechanism allows the blade to be removed from the first arm;

wherein the release mechanism includes a sleeve moveable relative to the first and second arms and to the blade, and wherein the sleeve is positioned within an opening of the blade when the release mechanism is in the first position and wherein the sleeve is positioned out of the opening of the blade when the release mechanism is in the second position; and wherein the sleeve defines at least part of the hinge assembly about which the first and second arms pivot.

2. The cutting assembly of claim 1, wherein the release mechanism includes a resilient member configured to bias the release mechanism from the second position to the first position.

3. The cutting assembly of claim 2, wherein the resilient member includes a spring.

4. The cutting assembly of claim 1, wherein the mounting unit includes a frame and an insert configured to support the blade in the cutting assembly, wherein the insert is configured to fit at least partly within the frame to receive at least part of the blade therein.

5. A cutting assembly configured to cut tubing, the cutting assembly comprising:

first and second arms pivotally coupled together;

a blade releasably coupled to the first arm, the blade including a tab disposed toward an end portion of the blade;

a mounting unit configured to support the blade in the cutting assembly and inhibit rotational movement of the blade relative to the first and second arms, the mounting unit including a frame having an opening configured to receive the tab of the blade to thereby help align and/or retain the blade in the frame of the mounting unit; and a release mechanism operable to couple the mounting unit and the blade to the first arm, the release mechanism including a sleeve moveable relative to the first and second arms and operable to support pivoting movement of the first arm relative to the second arm;

wherein the sleeve is positioned within an opening of the blade when the release mechanism is in a first position to thereby couple the blade to the first arm, and wherein the sleeve is positioned out of the opening of the blade when the release mechanism is in a second position to thereby allow the blade to be removed from the first arm.

6. The cutting assembly of claim 5, wherein the mounting unit includes an insert configured to support the blade in the cutting assembly, wherein the insert is configured to fit at least partly within the frame to receive at least part of the blade therein.

7. The cutting assembly of claim 6, wherein the frame and insert are disposed on the first arm of the cutting assembly, and wherein the frame includes at least one keyed structure configured to align with a corresponding structure on the first arm to thereby help align the frame on the first arm.

8. The cutting assembly of claim 6, wherein the insert includes a tab configured to fit within a corresponding opening of the frame to thereby help align and/or retain the insert within the frame.

9. The cutting assembly of claim 5, wherein the mounting unit includes a receptacle, and wherein the blade is removable from the first arm by sliding the blade longitudinally out of the receptacle of the mounting unit in a direction along the longitudinal axis of the first arm.

10. A cutting assembly configured to cut tubing, the cutting assembly comprising:

first and second arms pivotally coupled together such that the first arm can pivot relative to the second arm;

a blade releasably coupled to the first arm and oriented such that a longitudinal axis of the blade is generally parallel to a longitudinal axis of the first arm;

a mounting unit configured to support the blade in the cutting assembly and inhibit rotational movement of the blade relative to the first and second arms; and a release mechanism coupling the mounting unit to the first arm, the release mechanism moveable between a first position in which the release mechanism further couples the blade to the first arm and a second position in which the release mechanism allows the blade to be removed from the first arm, wherein the release mechanism includes a resilient member configured to bias the release mechanism from the second position toward the first position;

wherein the release mechanism includes a sleeve moveable relative to the first and second arms and to the blade, and wherein the sleeve is positioned within an opening of the blade when the release mechanism is in the first position and the sleeve is positioned out of the opening of the blade when the release mechanism is in the second position; and wherein the sleeve defines at least part of a hinge assembly about which the first and second arms pivot.

11. The cutting assembly of claim 10, wherein the release mechanism allows the blade to be removed from the first arm without decoupling the first arm and the second arm.

12. The cutting assembly of claim 1, wherein the blade is selectively removable from the first arm by sliding the blade longitudinally in a direction along the longitudinal axis of the first arm.

* * * * *